US010927617B2

(12) United States Patent
Magnuson et al.

(10) Patent No.: US 10,927,617 B2
(45) Date of Patent: Feb. 23, 2021

(54) CATWALK TUBULAR MEASUREMENT AND METHOD OF USE

(71) Applicant: Nabors Drilling Technologies USA, Inc., Houston, TX (US)

(72) Inventors: Christopher Magnuson, Houston, TX (US); Mario Sazo, Humble, TX (US); Alex Kunec, Tomball, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 43 days.

(21) Appl. No.: 16/208,125

(22) Filed: Dec. 3, 2018

(65) Prior Publication Data

US 2019/0186216 A1 Jun. 20, 2019

Related U.S. Application Data

(60) Provisional application No. 62/607,186, filed on Dec. 18, 2017.

(51) Int. Cl.

| | |
|---|---|
| ***E21B 19/16*** | (2006.01) |
| ***E21B 15/00*** | (2006.01) |
| ***E21B 19/02*** | (2006.01) |
| *E21B 17/00* | (2006.01) |
| *E21B 19/15* | (2006.01) |

(52) U.S. Cl.
CPC ..... *E21B 19/16* (2013.01); *E21B 15/00* (2013.01); *E21B 19/02* (2013.01); *E21B 19/165* (2013.01); *E21B 17/006* (2013.01); *E21B 19/15* (2013.01)

(58) Field of Classification Search
CPC ..... E21B 19/16; E21B 19/165; E21B 19/02; E21B 19/15; E21B 15/00; E21B 17/006
See application file for complete search history.

(56) References Cited

U.S. PATENT DOCUMENTS

| | | | | |
|---|---|---|---|---|
| 5,954,186 | A * | 9/1999 | Stroobandt | B65G 43/04 198/502.4 |
| 2012/0212326 | A1* | 8/2012 | Christiansen | H04Q 9/00 340/10.1 |
| 2016/0060980 | A1* | 3/2016 | Magnuson | G01G 19/52 340/666 |
| 2018/0149010 | A1* | 5/2018 | Zheng | E21B 44/00 |
| 2019/0153852 | A1* | 5/2019 | Lallemand | E21B 47/12 |

* cited by examiner

*Primary Examiner* — Giovanna Wright
*Assistant Examiner* — Yanick A Akaragwe
(74) *Attorney, Agent, or Firm* — Adolph Locklar

(57) ABSTRACT

A carrier assembly for a catwalk assembly includes a carrier. The carrier assembly includes a skate to move a tubular member along the carrier. The carrier assembly includes a proximity sensor positioned to detect the end of the tubular member as it moves along the carrier. The carrier assembly includes a skate position sensor. The length of the tubular member may be determined by measuring the position of the skate relative to the proximity sensor when the end of the tubular member passes the proximity sensor.

5 Claims, 4 Drawing Sheets

CATWALK TUBULAR MEASUREMENT AND METHOD OF USE

CROSS-REFERENCE TO RELATED APPLICATION

This application is a nonprovisional application that claims priority from U.S. provisional application No. 62/607,186, filed Dec. 18, 2017, the entirety of which is hereby incorporated by reference.

TECHNICAL FIELD/FIELD OF THE DISCLOSURE

The present disclosure relates generally to drilling rig equipment, and specifically to methods and apparatuses for tubular length measurement.

BACKGROUND OF THE DISCLOSURE

When performing a wellbore operation such as a drilling operation, a tubular string may be introduced into the wellbore. Typically, the tubular string includes a plurality of tubular members and other downhole tools joined end-to-end by threaded joints to extend into the wellbore. Tubular members, as used herein, include but are not limited to drill pipes, casings, and other tools threadedly connected to the tubular string. These tubulars are normally assembled in groups of two or more—commonly known as "stands"—to be vertically stored in the derrick or mast of the drilling rig. These stands are then connected together to form the tubular string.

Rotary drilling and top drive drilling systems often use these stands, instead of single tubulars, to increase efficiency of drilling operations by reducing the amount of connections required to build the drill string in or directly over the wellbore. Traditional drilling systems responsible for tracking the depth of the tubular string in the wellbore utilize algorithms to track and estimate the actual depth. These estimates must be constantly updated and require knowledge of the specifications of the tubular members and other components that have been connected to the drill string. Typically, these specifications are logged manually into a pipe tally database. Such a process is laborious as tubular members are not always the same length due to recuts and special-order lengths, and the pipe tally database may be inaccurate due to human error.

SUMMARY

An embodiment includes a carrier assembly for a catwalk. The carrier assembly includes a carrier, the carrier adapted to move a tubular member along the length of the carrier and a skate, the skate slideable along the carrier. The skate is positioned to engage the lower end of the tubular member and move the tubular member along the carrier. The carrier assembly also includes a proximity sensor, the proximity sensor positioned on the carrier. The proximity sensor has a sensitive axis or plane positioned to intersect the tubular member when the tubular member is in alignment with the proximity sensor. The carrier assembly further includes a skate position sensor, the skate position sensor adapted to measure the position of the skate along the carrier.

An embodiment includes a method. The method includes positioning a carrier assembly between a catwalk and the V-door of a drilling rig. The carrier assembly includes a carrier, the carrier adapted to move a tubular member along the length of the carrier. The carrier assembly also includes a skate. The skate is slideable along the carrier and is positioned to engage the lower end of the tubular member and move the tubular member along the carrier. The carrier assembly also includes a proximity sensor, the proximity sensor positioned on the carrier. The proximity sensor has a sensitive axis or plane positioned to intersect the tubular member when the tubular member is in alignment with the proximity sensor. The carrier assembly further includes a skate position sensor, the skate position sensor adapted to measure the position of the skate along the carrier. The method includes positioning a tubular member onto the carrier and moving the tubular member along the carrier with the skate. In addition, the method includes detecting the upper end of the tubular member with the proximity sensor when the upper end of the tubular member is in alignment with the sensitive axis or plane of the proximity sensor. In addition, the method includes measuring the position of the skate with the skate position sensor and determining the length of the tubular member.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
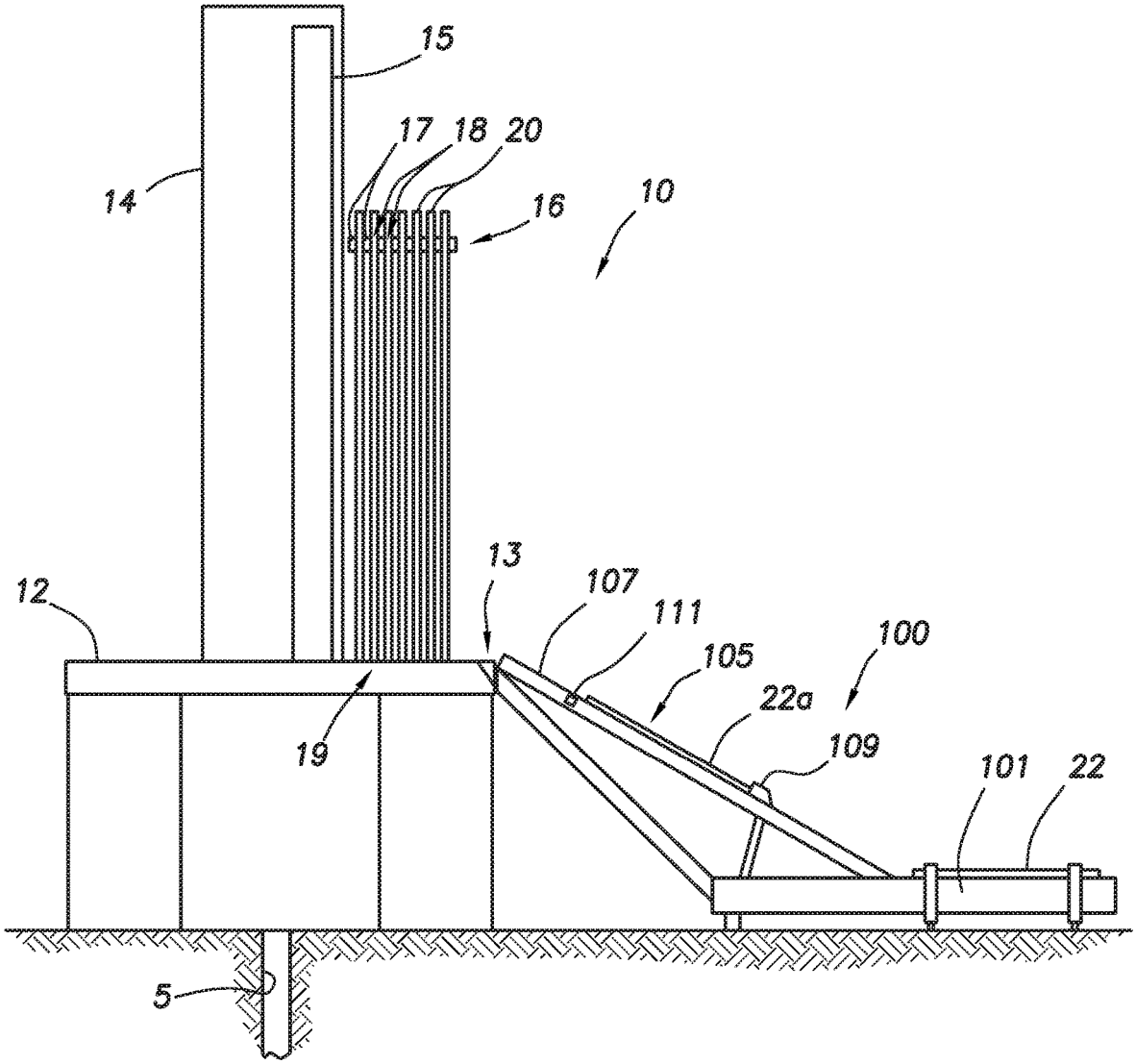
FIG. 1 depicts a drilling rig and catwalk consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts drilling rig 10 positioned to perform wellbore operations on wellbore 5. Drilling rig 10 may include drill floor 12 and mast 14. Drilling rig 10 may include V-door 13. V-door 13, as understood in the art, may be an opening in or open area of drill floor 12 through which tubular members may be introduced to drilling rig 10 from catwalk assembly 100 as further discussed herein below. Drilling rig 10 may include pipe handling apparatus 15. Drilling rig 10 may include fingerboard 16. Fingerboard 16, shown schematically, may include fingers 17. Fingers 17 may be elongated structures that extend parallel to each other to define rack slots 18. Rack slots 18 may receive pipe stands 20. Pipe stands 20 may, when stored in fingerboard 16, rest on setback 19 on drill floor 12. Pipe stands 20 may be placed into fingerboard 16 by pipe handling apparatus 15 or by any other hoisting apparatus.

In some embodiments, catwalk assembly 100 may include catwalk deck 101. Catwalk deck 101 may be formed from one or more horizontal structures used to support and store tubular members 22 that have not yet been introduced into drilling rig 10. In some embodiments, catwalk assembly 100 may include carrier assembly 105. Carrier assembly 105 may include carrier 107. Carrier 107 may be an inclined surface extending generally between catwalk deck 101 and V-door 13 of drilling rig 10. Carrier 107 may be used to move tubular members 22 (here depicted as moving tubular member 22*a*) from catwalk deck 101 to drilling rig 10.

Figure 2:
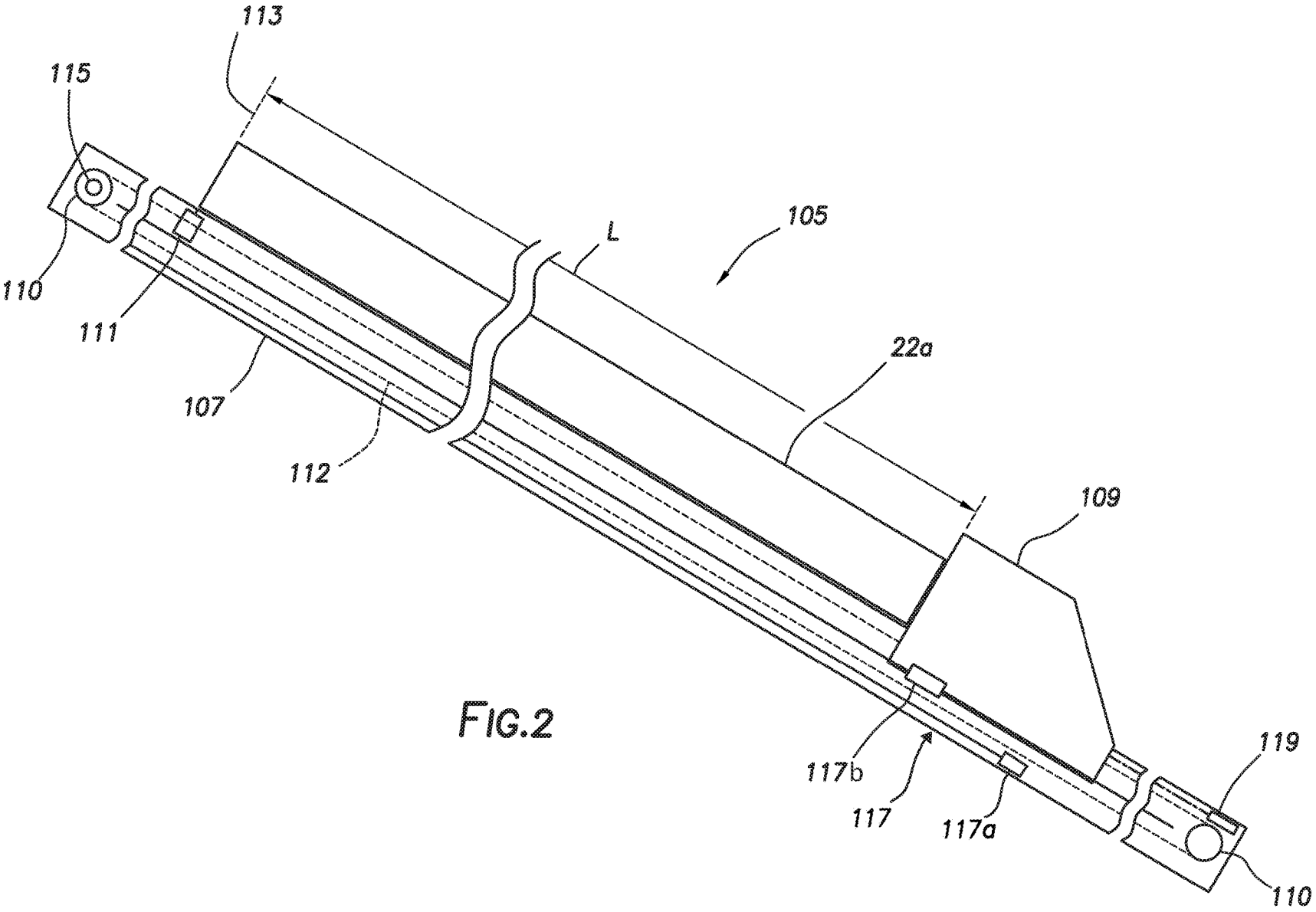
FIG. 2 depicts a schematic view of a carrier of a catwalk assembly consistent with at least one embodiment of the present disclosure.

In some embodiments, as depicted in FIG. 2, carrier 107 may include skate 109. Skate 109 may be a structure adapted to move along the length of carrier 107. Skate 109 may be driven by, for example and without limitation, one or more pulleys 110 and one or more ropes, wire ropes, or chains 112. Skate 109 may be used to move tubular member 22*a* up carrier 107 toward drilling rig 10. Skate 109 may engage a lower end of tubular member 22*a* and, as skate 109 is driven up carrier 107, may push tubular member 22*a* up carrier 107 until tubular member 22*a* enters V-door 13 of drilling rig 10. Tubular member 22*a* may then be maneuvered within drilling rig 10 by, for example and without limitation, pipe handling apparatus 15 or other hoisting apparatus.

In some embodiments, carrier 107 may include proximity sensor 111. Proximity sensor 111 may be positioned on carrier 107 to detect when tubular member 22*a* is positioned on carrier 107 in alignment with proximity sensor 111. Proximity sensor 111 may be any sensor known in the art, including, for example and without limitation, one or more of an ultrasonic sensor, photoelectrical sensor, or inductive sensor. In some embodiments, as tubular member 22*a* passes proximity sensor 111 as it is moved by skate 109, proximity sensor 111 may detect the upper end of tubular member 22*a*.

Figure 3:
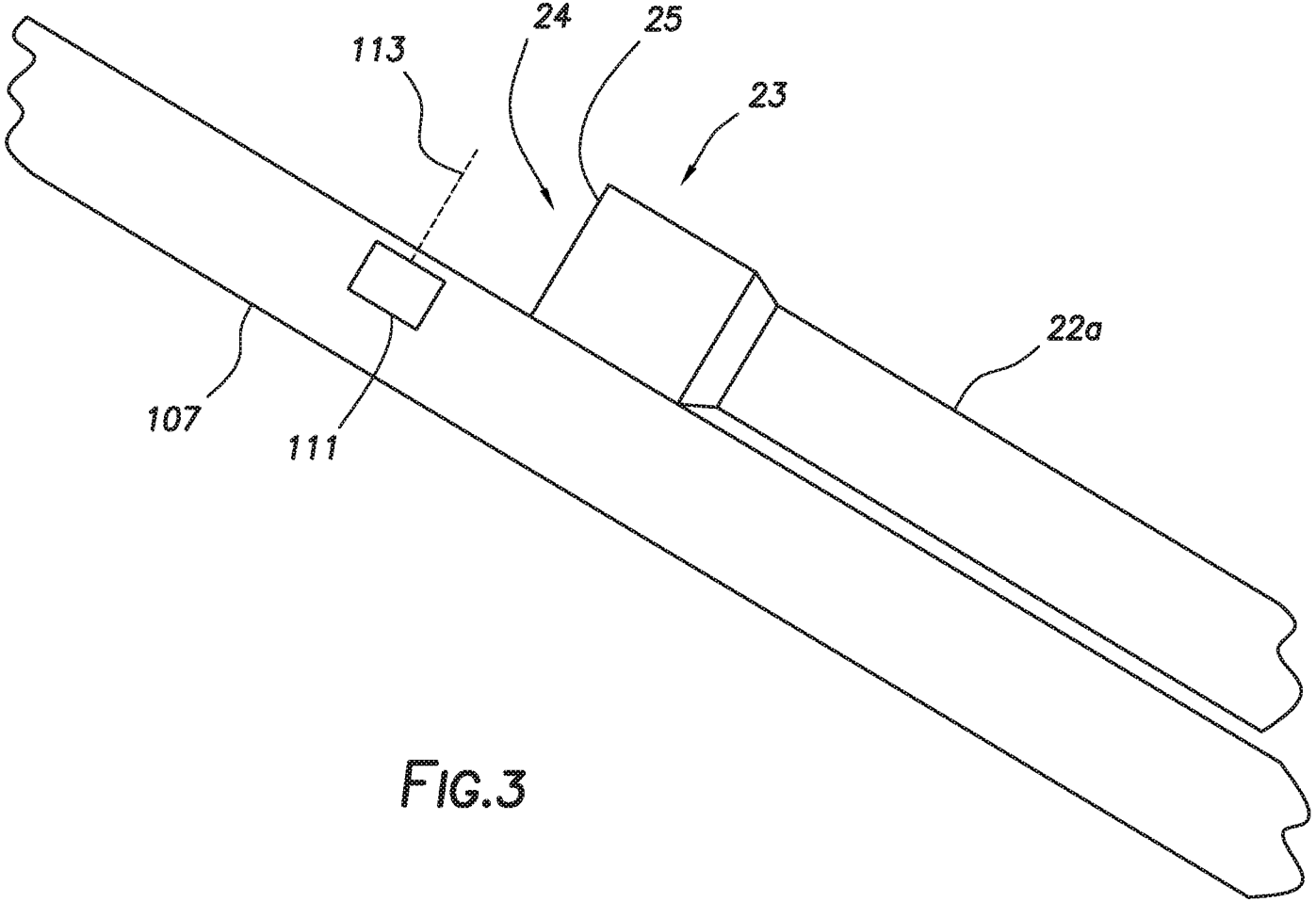
FIGS. 3 and 4 depict schematic detail views of a carrier of a catwalk assembly consistent with at least one embodiment of the present disclosure.
Figure 4:
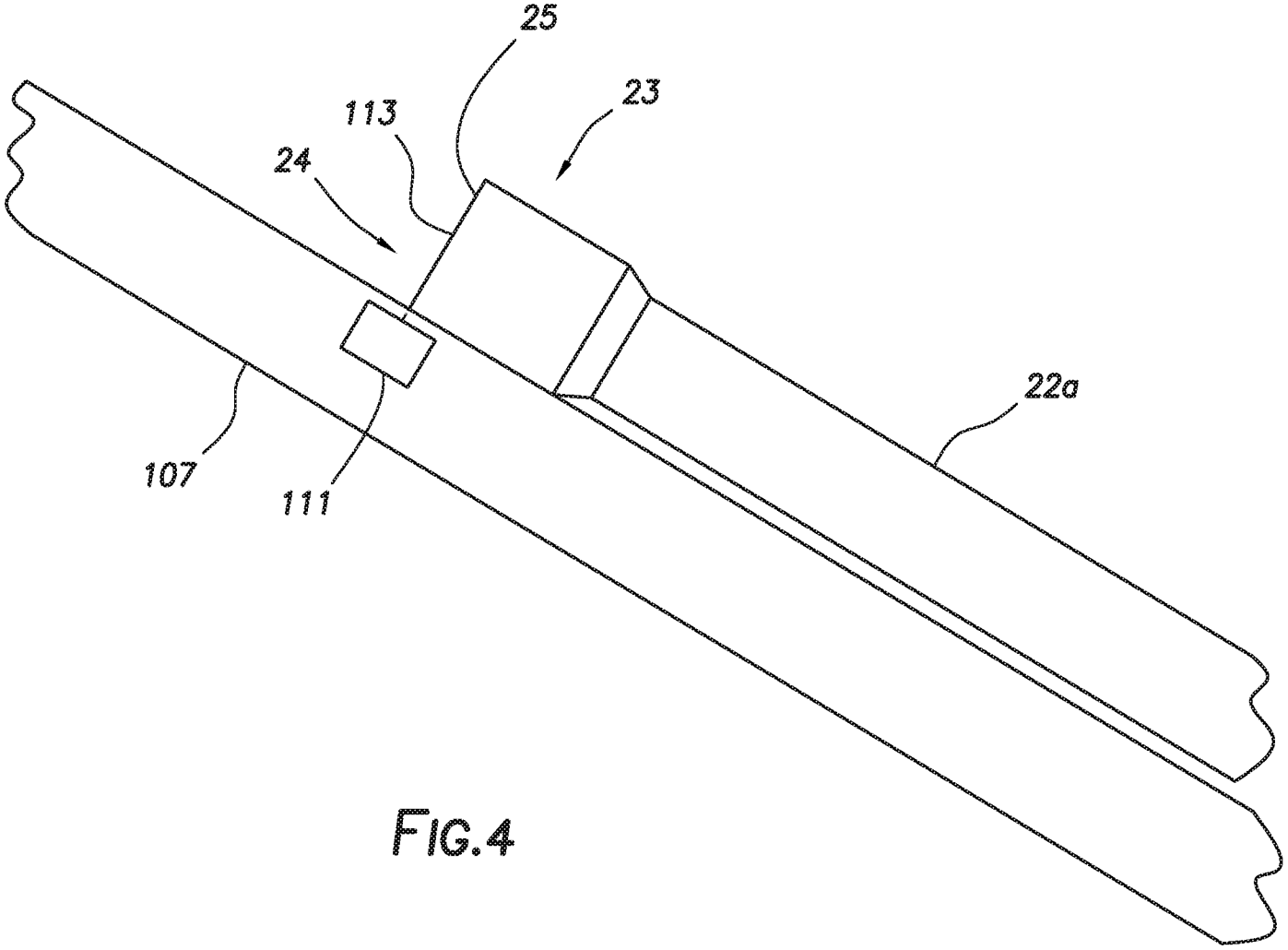

In some embodiments, as depicted in FIGS. 3 and 4, proximity sensor 111 may have a sensitive axis or plane 113 along which proximity sensor 111 is capable of detecting the presence of tubular member 22*a*. Sensitive axis or plane 113 may be positioned to intersect tubular member 22*a* when tubular member 22*a* is in alignment with proximity sensor 111 as tubular member 22*a* moves along carrier 107. As shown in FIG. 2, as tubular member 22*a* moves along carrier 107, proximity sensor 111 may be activated to detect tubular member 22*a* once tubular member 22*a* is aligned with sensitive axis or plane 113. In some embodiments, as the upper end of tubular member 22*a* moves along carrier 107 into alignment with sensitive axis or plane 113 of proximity sensor 111, proximity sensor 111 may detect the presence of tubular member 22*a* as depicted in FIG. 3. In some embodiments, where the upper end of tubular member 22*a* includes tool joint 23 having box connection 24, proximity sensor 111 may detect the upper end of tubular member 22*a* as the end of box connection 24. In some embodiments, as tubular member 22*a* continues to move along carrier 107, proximity sensor 111 may detect shoulder 25 of tool joint 23 as depicted in FIG. 4. In some such embodiments, shoulder 25 may be detected as, for example and without limitation, a change in distance between tubular member 22*a* and proximity sensor 111 or proximity sensor 111 may be otherwise configured or positioned to detect the change in diameter of tubular member 22*a* at shoulder 25. In some embodiments, proximity sensor 111 may be used to measure the dimensions of box connection 24 including, for example and without limitation, the length of box connection 24, the change in diameter of tubular member 22*a* across shoulder 25, or other such measurements. In some embodiments, proximity sensor 111 may be used to measure the length of the pin section of tubular member 22*a*. Proximity sensor 111 may be used to measure various lengths in combination with skate position sensors as discussed below.

In some embodiments, as depicted in FIG. 2, the position of skate 109 along carrier 107 may be measured. The position of skate 109 along carrier 107 may be measured by one or more skate position sensors. Skate position sensors may, for example and without limitation, include one or more of encoders 115, linear variable differential transformer (LVDT) 117 that may include LVDT 117*a* and magnet 117*b*, or lasers 119. In some embodiments, the measured position of skate 109 along carrier 107 may be used to determine the distance between sensitive axis or plane 113 of proximity sensor 111 and skate 109. By knowing the distance between skate 109, and therefore the lower end of tubular member 22*a*, and sensitive axis or plane 113 of proximity sensor 111 when proximity sensor 111 detects the upper end of tubular member 22*a*, the length L of tubular member 22*a* may be determined. In some embodiments, the determined length of tubular member 22*a* may be stored or transmitted to other equipment of drilling rig 10. In some embodiments, the determined length of tubular member 22*a* may be used, for example and without limitation, in a pipe tally database. A pipe tally database, as understood in the art, is a list of the components of a tubular string positioned in wellbore 5. The pipe tally database may indicate, among other information, the total length of the tubular string, which may be used to position tools accurately within the wellbore. In some embodiments, as discussed above, by measuring the distance to shoulder 25 of tool joint 23 of tubular member 22*a*, the length of tubular member 22*a* when installed to a tubular string or stand may be measured.

In some embodiments, the length of each tubular member 22 presented to drilling rig 10 may be measured and added to the pipe tally database as each tubular member 22 moves from catwalk deck 101 to drilling rig 10. Knowing the length of each tubular member 22 that is included in a tubular string in wellbore 5 may, for example and without limitation, allow the depth of the tubular string in wellbore 5 to be tracked accurately, as well as the position of each tool joint of the tubular string to be known without relying on the manual entry of each pipe length as it is added to the tubular string.

In some embodiments in which multiple sensors are used to determine the position of skate 109 along carrier 107 may, in some embodiments, allow for error-checking of the position of skate 109. For example and without limitation, in some embodiments, slippage in wire rope-based positioning system for skate 109 may be identified using two or more skate position sensors such as encoders 115, LVDT 117, or lasers 119 by, for example and without limitation, comparing measurements made by the two or more skate position sensors.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A method comprising:

positioning a carrier assembly between a catwalk deck and the V-door of a drilling rig, the carrier assembly including:

a carrier, the carrier adapted to move a tubular member along the length of the carrier;

a skate, the skate slideable along the carrier, the skate positioned to engage a lower end of the tubular member and move the tubular member along the carrier, wherein the skate is driven by one or more pulleys and one or more ropes, wire ropes, or chains;

a proximity sensor, the proximity sensor positioned on the carrier, the proximity sensor having a sensitive axis or plane positioned to intersect the tubular member when the tubular member is in alignment with the proximity sensor;

a first skate position sensor, the first skate position sensor adapted to measure the position of the skate along the carrier; and a second skate position sensor;

positioning the tubular member onto the carrier;

moving the tubular member along the carrier with the skate;

detecting the upper end of the tubular member with the proximity sensor when the upper end of the tubular member is in alignment with the sensitive axis or plane of the proximity sensor;

measuring the position of the skate with the skate position sensor;

determining the length of the tubular member;

measuring the position of the skate with the second skate position sensor;

comparing the measurement of the first skate position sensor with the measurement of the second skate position sensor; and determining if slippage in the wire rope has occurred.

2. The method of claim 1, wherein the proximity sensor is an ultrasonic sensor or a photoelectrical sensor.

3. The method of claim 1, wherein the skate position sensor is an encoder, linear variable differential transformer (LVDT), or laser.

4. The method of claim 1, wherein the tubular member further comprises a shoulder of a box joint, and wherein the method further comprises:

moving the tubular member along the carrier with the skate;

detecting the shoulder with the proximity sensor;

measuring the position of the skate with the skate position sensor; and determining the length of the box joint.

5. The method of claim 4, further comprising determining, with the proximity sensor, the change in diameter of the tubular member at the shoulder.

* * * * *